US008047449B2

(12) United States Patent
Lou et al.

(10) Patent No.: US 8,047,449 B2
(45) Date of Patent: Nov. 1, 2011

(54) AUTOMOTIVE THERMOSTATIC EXPANSION VALVE WITH REDUCED HISS

(75) Inventors: Zheng Lou, Plymouth, MI (US); Thomas J. Joseph, Sr., Commerce, MI (US); Thomas B. Harris, Taylor, MI (US)

(73) Assignee: Automotive Components Holdings LLC, Dearborn, MI (US)

( * ) Notice: Subject to any disclaimer, the term of this patent is extended or adjusted under 35 U.S.C. 154(b) by 429 days.

(21) Appl. No.: 12/361,034

(22) Filed: Jan. 28, 2009

(65) Prior Publication Data

US 2010/0186434 A1 Jul. 29, 2010

(51) Int. Cl.
*F25B 41/04* (2006.01)
*F25B 41/06* (2006.01)

(52) U.S. Cl. ..... 236/92 B; 62/217; 62/222

(58) Field of Classification Search ..... 236/92 B; 62/217, 222, 224, 225, 296
See application file for complete search history.

(56) References Cited

U.S. PATENT DOCUMENTS

| | | | | |
|---|---|---|---|---|
| 3,367,130 | A | 2/1968 | Owens | |
| 6,430,950 | B1 | 8/2002 | Dienhart et al. | |
| 6,543,239 | B2 | 4/2003 | Mittelstrass et al. | |
| 6,712,281 | B2 * | 3/2004 | Hirota et al. | 236/92 B |
| 7,243,501 | B2 | 7/2007 | Yahia et al. | |
| 2008/0184717 | A1 | 8/2008 | Sienel et al. | |

FOREIGN PATENT DOCUMENTS

WO 2008074383 A1 6/2008

OTHER PUBLICATIONS

SAE Technical Paper 2001-01-1717, Instabilities Occurring in an Automotive A/C Loop Equipped with an Externally Controlled Compressor and a Thermal Expansion Valve, B. Hamery, J.M. Liu and C. Riviere, May 14-17, 2001.

* cited by examiner

*Primary Examiner* — Marc Norman
(74) *Attorney, Agent, or Firm* — MacMillian, Sobanski & Todd, LLC

(57) ABSTRACT

An expansion valve for an air conditioning system circulates refrigerant through a fixed-displacement compressor, a condenser, and an evaporator. An inlet is provided for receiving refrigerant liquefied in the condenser. An outlet of the expansion valve supplies refrigerant to the evaporator. A valve element controls flow of refrigerant between the inlet and the outlet, wherein the valve element is normally closed. A control assembly is coupled to the valve element and is responsive to at least one temperature or pressure in the air conditioning system to open the valve element to variably meter the refrigerant to the evaporator. A bleed passage bypasses the valve element to conduct refrigerant between the inlet and the outlet. The bleed passage is adapted to bleed refrigerant to the evaporator immediately after the compressor shuts off to prime the air conditioning system for a lower superheat when the compressor turns on, and the bleed path has a flow capacity substantially smaller than the flow capacity of the main valve aperture.

11 Claims, 5 Drawing Sheets

AUTOMOTIVE THERMOSTATIC EXPANSION VALVE WITH REDUCED HISS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to automotive air conditioning systems, and, more specifically, to an expansion valve with reduced hissing noise.

A thermal, or thermostatic, expansion valve (TXV) is widely used in air conditioning systems to control the superheat at the evaporator outlet. A TXV throttles refrigerant and generates a hissing noise. The hiss noise is especially prominent when the TXV first opens, e.g., upon opening during normal cycling of the valve or when the compressor is first started. The repetitive nature of the cycling of the TXV during system operation makes the hiss noise especially undesirable.

To resolve this problem, the size of the valve opening may be reduced by design, but this may unduly limit the cool-down performance of the system. Furthermore, it does not resolve the issue of rapid valve opening at the compressor startup and thus has limited beneficial effect. Another solution to this problem has been to add screens at the TXV inlets and outlets, but empirical evidence shows that such screens have only a limited effect in reducing the hiss noise.

Another approach has been to slow down or delay the opening of the TXV, thereby allowing more time for the high pressure side of the refrigerant loop to rise up. The system reaches a more sub-cooled state before allowing a high rate of flow through the TXV, thereby absorbing residual vapor, reducing the initial refrigerant flow rate, and reducing hiss. As disclosed in Lou et al, U.S. application Ser. No. 11/893,691, filed Aug. 17, 2007, entitled "Thermostatic Expansion Valve," the use of a restricted flow between the evaporator outlet and the pressure chamber in the charge assembly controlling the opening of the TXV is one way to achieve the desired delay. Another solution is given by Lou et al, U.S. application Ser. No. 12/123,865, filed May 20, 2008, entitled "Air Conditioning Circuit Control Using a Thermostatic Expansion Valve and Sequence Valve," wherein a sequence valve is added in series with the TXV to prevent flow through the TXV until the desired sub-cooled state is reached.

Although the foregoing measures achieve desirable reductions in hiss noise, they add complexity and cost over expansion valves without these features. It would be desirable to reduce the added cost and complexity while maintaining the desirable reduction in hiss from the TXV.

SUMMARY OF THE INVENTION

In one aspect of the invention, an expansion valve for an air conditioning system circulates refrigerant through a fixed-displacement compressor, a condenser, and an evaporator. An inlet is provided for receiving refrigerant liquefied in the condenser. An outlet of the expansion valve supplies refrigerant to the evaporator. A valve element controls flow of refrigerant between the inlet and the outlet, wherein the valve element is normally closed. A control assembly is coupled to the valve element and is responsive to at least one temperature or pressure in the air conditioning system to open the valve element to variably meter the refrigerant to the evaporator. A bleed passage bypasses the valve element to conduct refrigerant between the inlet and the outlet. The bleed passage is adapted to bleed refrigerant to the evaporator immediately after the compressor shuts off to prime the air conditioning system for a lower superheat when the compressor turns on, and the bleed path has a flow capacity substantially smaller than the flow capacity of the main valve aperture.

In a further aspect of the invention, a check valve is placed in the bleed passage for substantially blocking refrigerant flow in the direction from the outlet to the inlet at all times. The check valve may be biased for blocking refrigerant flow in the direction from the inlet to the outlet unless the pressure of refrigerant in the inlet is greater than the pressure of refrigerant in the outlet by a predetermined threshold.

DETAILED DESCRIPTION OF PREFERRED EMBODIMENTS

Figure 1:
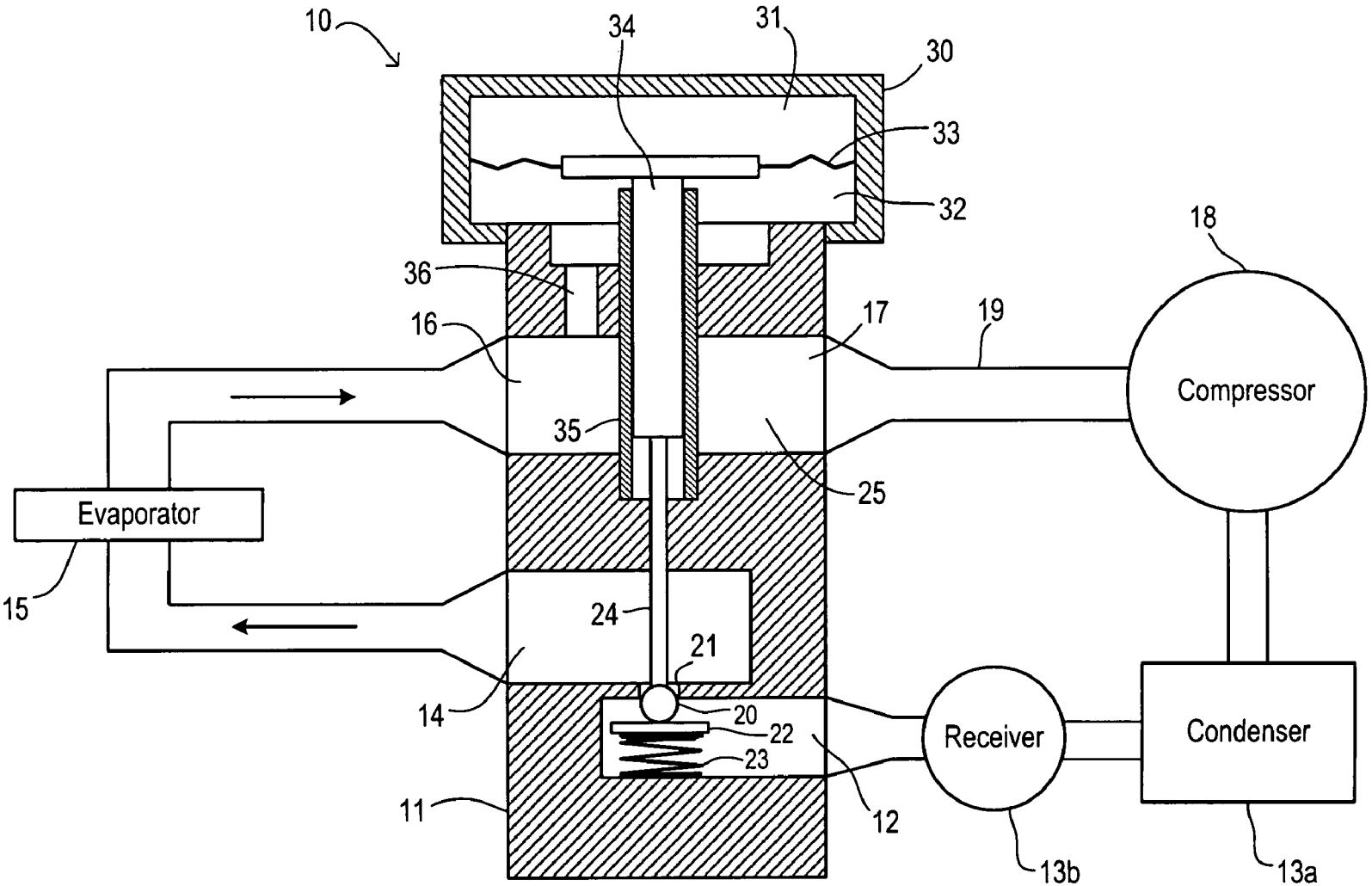
Fig. 1 (Prior Art)
FIG. 1 is a cross-sectional view through a prior art expansion valve connected in a conventional air conditioning system.

Referring to FIG. 1, a thermostatic expansion valve (TXV) 10 has a valve body 11 with a port 12 (typically referred to as Port A in the art) for receiving liquid refrigerant from a receiver 13*b*. Valve body 11 has a port 14 (commonly referred to as Port B) coupled to the inlet of an evaporator 15. Valve body 11 has a port 16 (commonly referred to as Port C) receiving superheated gaseous refrigerant from evaporator 15. A port 17 in valve body 11 (commonly referred to as Port D) is coupled to the input of a compressor 18. A line 19 between port 17 and compressor 18 is known as a suction line. Gaseous refrigerant compressed by compressor 18 is provided to condenser 13*a* for condensing and then to receiver 13*b* for storing the refrigerant in liquid form.

A valve element provided between inlet port 12 and outlet port 14 includes a ball valve 20 for seating in an aperture 21 provided in valve body 11 between ports 12 and 14. A biasing member 22 including a set spring 23 normally presses ball 20 into its seat within aperture 21 so that the valve element is normally closed. By "normally closed," it is meant that absent any forces intended to control the valve position, it will stay in the closed position. During normal system operation, however, the valve element spends most of the time being open to a variable or controlled degree. Set spring 23 is adjusted or calibrated to a predetermined TXV preload by a set screw (not shown). Ball valve 20 is coupled by a stem 24 to a charge assembly which controls opening of the valve element in response to the superheat of the refrigerant gas from the evaporator entering a sensor chamber 25 between ports 16 and 17.

A charge assembly housing 30 mounted to valve body 11 encloses a charge chamber 31 separated from a pressure chamber 32 by a diaphragm 33. Diaphragm 33 is coupled via a coupling 34 to stem 24 within an optional sleeve 35. Charge chamber 31 is sealed and contains a predetermined volume of a reference charge, such as a specific amount of the refrigerant. Pressure chamber 32 is coupled to sensor chamber 25 through a flow port 36 (having minimal flow resistance). In operation, changes in superheat of refrigerant returning from evaporator 15 cause corresponding movements in coupling 34 due to differences in pressure across diaphragm 33. As coupling 34 and stem 24 move up and down, an appropriate amount of refrigerant is metered through the valve element between ports 12 and 14 and a desired superheat is obtained.

Figure 2:
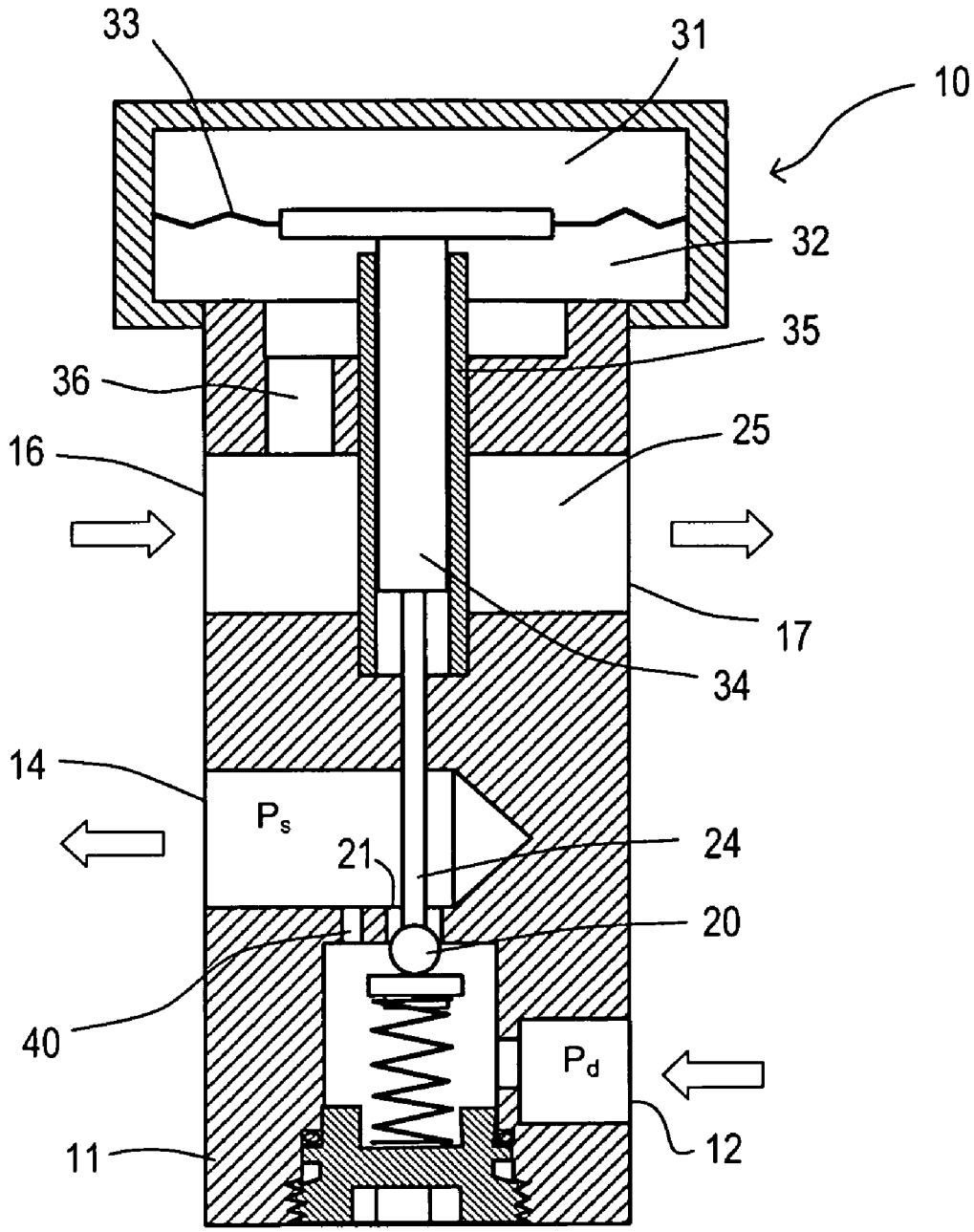
FIG. 2 is a cross section of a first embodiment of an expansion valve of the present invention having a bleed path.

The present invention includes the discovery that a controlled leakage through the valve element results in lower hiss noise during compressor cycling. Thus, a bleed path is provided by passing the valve element to conduct refrigerant between the inlet and outlet when the valve element is closed. In one embodiment shown in FIG. 2, the bleed path comprises a passage or bore 40 through valve body 11 in parallel with passage 21 to couple inlet 12 and outlet 14. Alternatively, the bleed path can be incorporated into the main valve element, for example. The flow capacity of passage 40 is significantly smaller than passage 21 so that only a small bleed flow is possible. Furthermore, the bleed path is adapted to bleed refrigerant to the evaporator immediately after the compressor shuts off to prime the air conditioning system for a lower superheat and reduced noise the next time the compressor turns on.

In a preferred embodiment, passage 40 is comprised of a bore having a diameter between about 0.5 mm and about 1.5 mm, or an opening of any shape having a cross-section or flow area between about 0.2 $mm^2$ and 1.77 $mm^2$. More preferably, the bore diameter may be between about 0.8 mm and about 1.0 mm, or the opening flow area may be between about 0.5 $mm^2$ and about 0.79 $mm^2$. When passage 40 includes more than one flow restriction either in parallel or in series, the opening flow area would have an equivalent or effective flow area which provides a flow resistance equivalent to a cylindrical bore with a diameter as given above. For example, when passage 40 includes two openings of flow area A1 and flow area A2 in parallel, then the effective flow area is approximately equal to A1+A2. If these two openings are in series, then the effective flow area is approximately equal to 1/(1/A1+1/A2). Also, implicit in the above diameter or flow area ranges is that the length of a bore or opening is generally short, i.e., on the same order of magnitude as the characteristic dimension of the flow area (e.g., the diameter in the case of a bore) or even shorter. One skilled in the art will be able to adjust the diameter or flow area ranges if the length of a bore or opening is much longer, i.e., larger diameter or flow area with a longer bore or opening, to generate an equivalent flow resistance or capacity.

During system operation with a cycling compressor, the differential pressure across the expansion valve (i.e., between inlet port 12 and outlet port 14) during a clutch-off period (i.e., when the compressor is turned off) falls or decays to a lower value as a result of bleeding (e.g., to about 3.3 bar instead of about 7 bar in a typical test). Moreover, the clutch-off suction side pressure ($P_S$) in outlet port 14 rises to a higher value (about 6 bar-gauge in the same test) with bleeding present than without a bleed path present (e.g., to about 3.7 bar-gauge in the same test). When the compressor cycles on, the superheat from the evaporator outlet rises to a lower transient value with bleed path 40 being present (e.g., about 5° to 8° Celsius rather than 30° Celsius in the same test) which avoids a major contributor to the hiss noise.

In order to effectively reduce hiss noise, the bleed path can have a size such that the clutch-off pressure differential between the inlet and outlet will fall or decay to a value that is reduced to between about 35% and about 65% of the corresponding value for the system without the bleed path. Preferably, the clutch-off pressure differential may fall or decay to a value that is reduced to between about 45% and about 55% of the clutch-off pressure differential that would otherwise be present.

One potential concern associated with an always-on bleed path is the potential for undesired charge migration during times when the air conditioning system is off. For example, there may be situations with substantial temperature differential between the underhood portion (e.g., the condenser) and the HVAC or instrument panel portion (e.g., the evaporator) of the air conditioning loop resulting in a corresponding saturation pressure differential that drives a charge migration through the bleed path in the expansion valve even when the air conditioning system is off.

Figure 3:
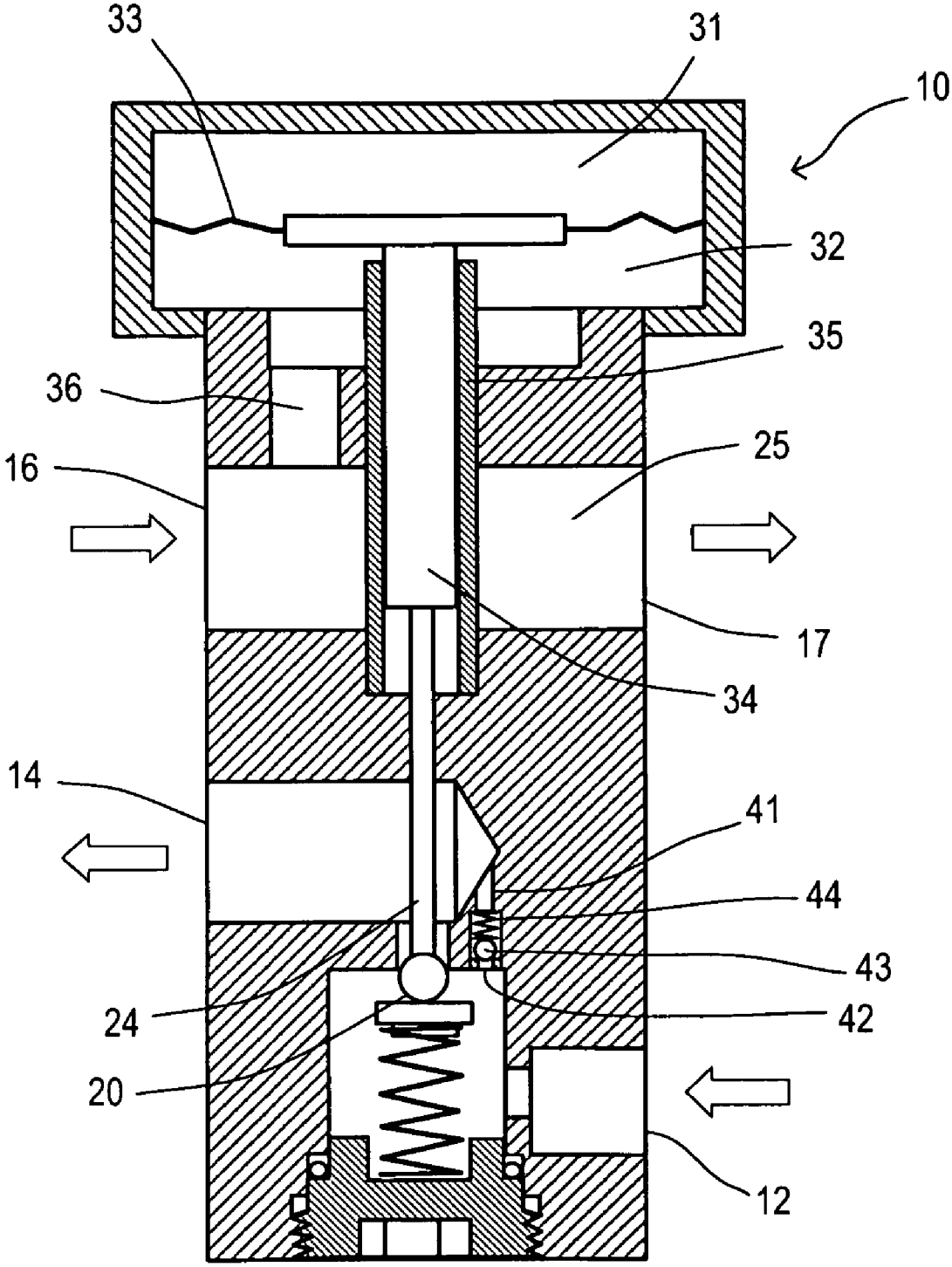
FIG. 3 is a cross section of a second embodiment of an expansion valve of the present invention having a checked bleed path.

FIG. 3 shows an alternative embodiment including a spring-loaded check valve in the bleed path for reducing charge migration while maintaining hiss noise reduction capability. Thus, a bleed passage 41 includes a flow restriction 42 at one end. A ball valve 43 is spring loaded by a spring 44 against restriction 42. Thus, a one-way valve is formed such that no refrigerant can pass through the bleed path from outlet 14 to inlet 12. Flow through the check valve from inlet 12 to outlet 14 occurs only after the pressure differential is greater than a predetermined threshold or check preload. The bias provided by spring 44 determines the predetermined threshold. Preferably, the predetermined threshold is set high enough to prevent or reduce charge migration caused by temperature differences during times with the air conditioning off and is set low enough to allow sufficient bleed flow during compressor clutch-off periods so that hiss noise is reduced. Preferably, the predetermined threshold is comprised of a pressure selected from the range between about 1 bar and 7 bar. Most preferably, the predetermined threshold may be about 4 bar.

Figure 4:
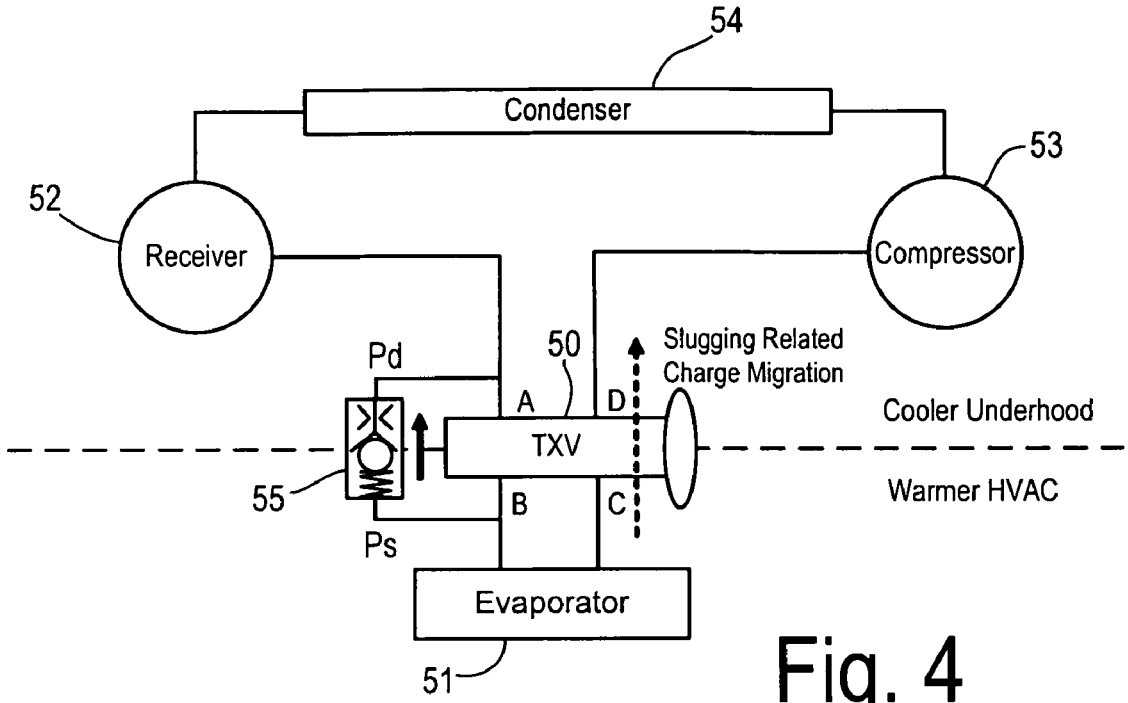
FIGS. 4 and 5 are schematic views showing the tendency of charge migration using the present invention when the air conditioning system is not active.
Figure 5:
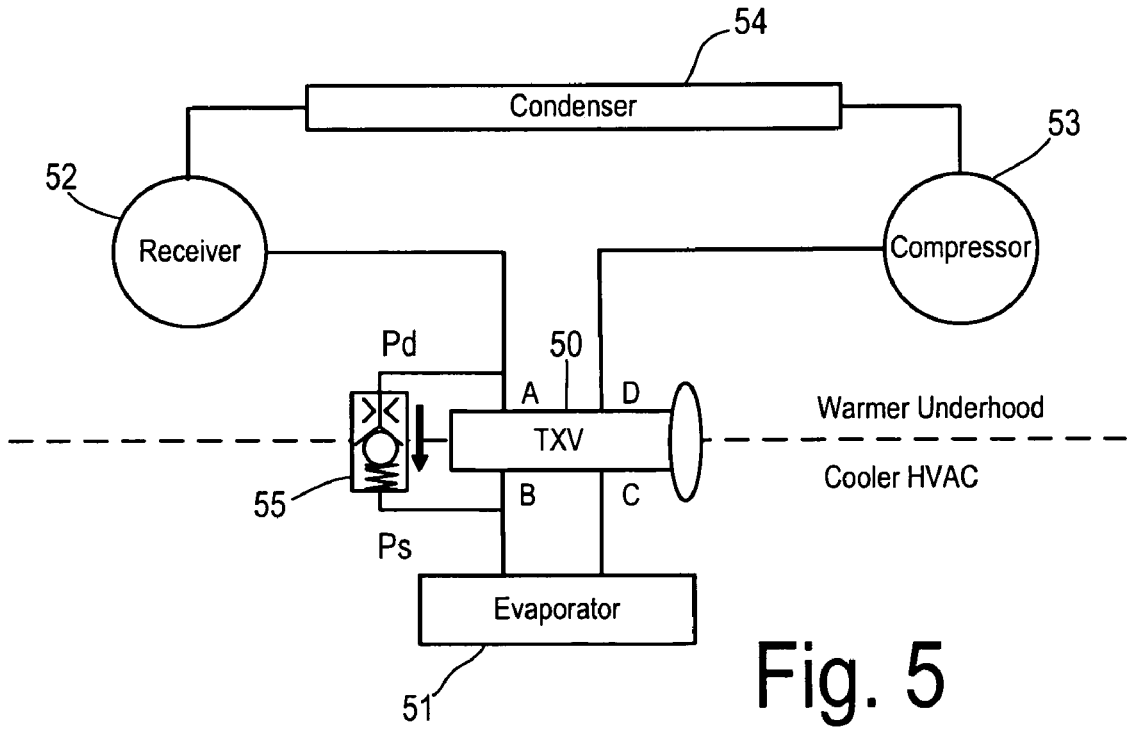

FIGS. 4 and 5 illustrate charge migration that results using the embodiment of FIG. 3. The bleed path affects charge migration only between ports A and B (e.g., between inlet 12 and outlet 14) and not between ports C and D.

When the underhood is cooler than the interior HVAC, as shown in FIG. 4, the underhood discharge refrigerant saturation pressure $P_d$ is lower than the corresponding HVAC suction saturation pressure $P_s$, resulting in a tendency for the charge or refrigerant to migrate from the Port B side to the Port C side, which is however blocked because of the checked bleed path. As in a conventional expansion valve system, there is still a charge migration between from port C to Port D known as slugging-related charge migration. But with the checked bleed, there is no extra migration through the bleed path and so associated slugging is no worse than that in a conventional system.

With the underhood warmer than the interior HVAC, as shown in FIG. 5, the corresponding underhood discharge refrigerant saturation pressure $P_d$ is higher than the corresponding HVAC suction saturation pressure $P_s$. The pressure differential (i.e., $P_d$–$P_s$) tends to drive the refrigerant from port A to port B. However, there is no charge migration as long as the pressure differential is less than the corresponding check pre-load on the check valve. As the temperature difference between the underhood and interior HVAC increases, a greater check preload pressure or bias would be necessary for the checked bleed valve to prevent charge migration. However, as the bias increases and the predetermined threshold rises, less reduction in hiss noise would be obtained. Thus, a balance is found according to a maximum temperature differential under which charge migration is to be prevented. In one example system, a predetermined threshold of about 4.45 bar was necessary to prevent charge migration at temperature differentials up to 20° Celsius.

Figure 6:
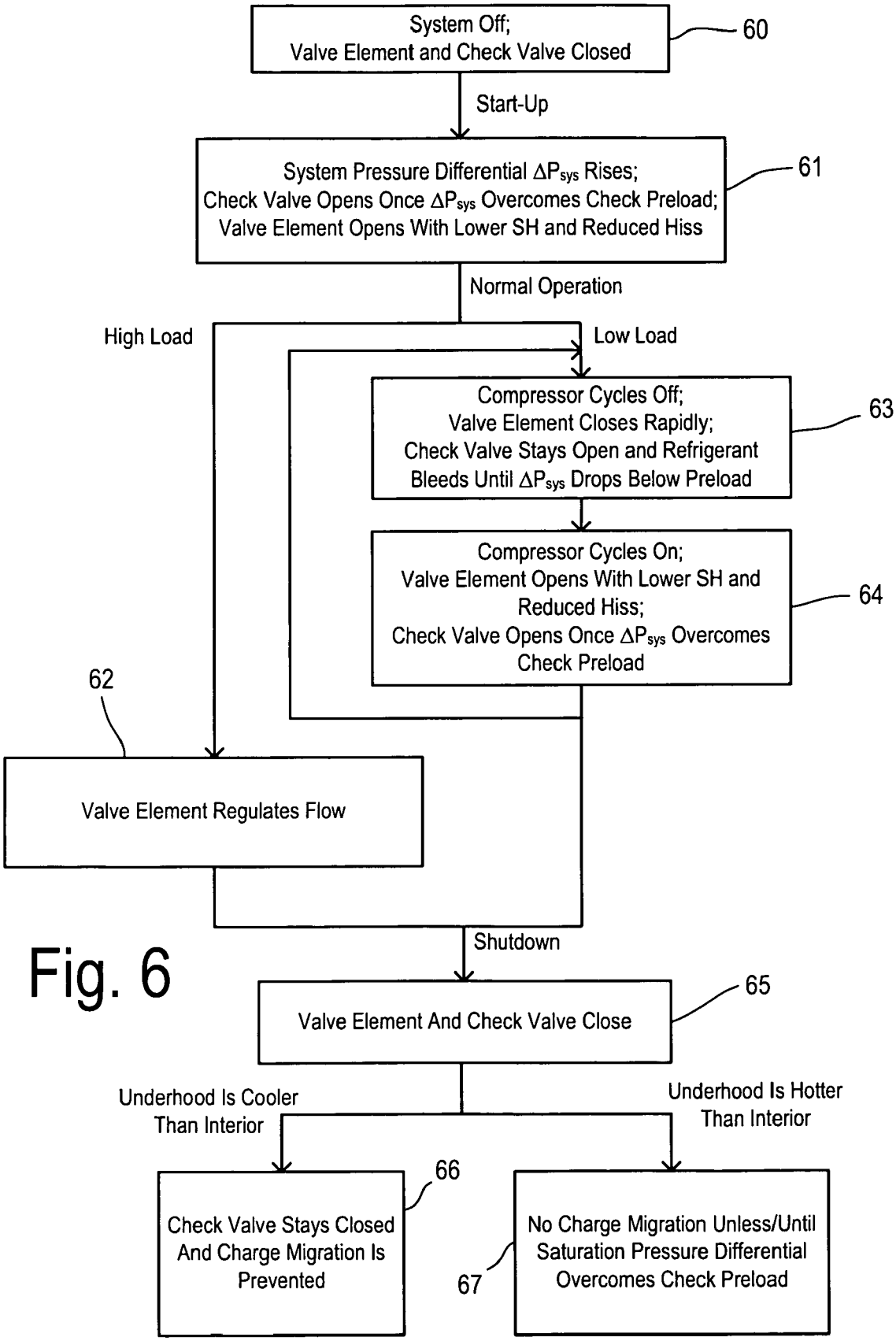
FIG. 6 is a flowchart showing a preferred operation of the invention.

A method of the present invention is shown in FIG. 6. In step 60, the air conditioning system is off and the valve element is closed. The air conditioning system is started up and then in step 61 the system pressure differential $\Delta P_{sys}$, (which equals $P_D$-$P_s$) rises and the check valve opens once the pressure differential $\Delta P_{sys}$, across the valve element exceeds the predetermined threshold. The valve element opens once the pressure force on the diaphragm is greater than the TXV preload, which happens quite readily in any compressor start-up or cycle-on. With this invention, the evaporator is likely to contain more charge or refrigerant, a residual effect from the bleed function at the end of last AC system operation. Therefore, there is a lower quality spike (or relatively higher liquid content) in the evaporator, which is manifested by a lower or insignificant superheat SH spike at the evaporator outlet, and thus a lower hiss noise spike shortly after the valve element opens. The refrigerant is able to absorb substantially more noise at lower quality. The opening of the check valve and thus the bleed path at the compressor start-up or cycle-on is believed to have only a secondary impact on the hiss noise. It is the bleed function immediately after compressor-off (either due to cycling-off or shutdown) that helps fill the evaporator with extra refrigerant and reduces the quality or superheat spike at the following compressor-on (either due to cycling-on or startup), which is the primary reason for the hiss noise reduction.

The air conditioning system then begins normal operation. In step 62 (if under normal or high AC load and thus no compressor cycling), the check valve keeps open under normal system pressure differential $\Delta P_{sys}$, which is generally much higher than the check preload. The valve element regulates the refrigerant flow and thus the evaporator outlet superheat. With the addition of the bleed path, the TXV valve element needs to be calibrated or designed accordingly to reflect the additional flow through the bleed path.

If under low AC load, a fixed-displacement compressor cycles off and on to match its total or average output with the need of the AC system. The cycling may happen as frequently as every 10 or 20 seconds. When the compressor cycles off in step 63, the valve element closes rapidly by design and system dynamics. The check valve stays open much longer, allowing a significant amount of refrigerant to bleed to the evaporator, and it closes when the system pressure differential $\Delta P_{sys}$ falls under the check preload, which may not happen if the cycling-off period is too short. With the bleed path, the system pressure differential $\Delta P_{sys}$ falls faster and to a lower value before the next cycling-on. In a conventional AC system without a bleed path, the system pressure differential $\Delta P_{sys}$ also falls, however at a slower rate, because of (1) a short period of bleed through a yet to be closed valve element, (2) leakage through the valve element after its closure, (3) leakage through the compressor, and (4) heat transfer or thermal equalization, which are also present for the system with the bleed path.

When the compressor cycles on in step 64, the valve element opens with lower superheat spike and thus reduced hiss noise because of the bleed action happened in step 63. The check valve opens up once the system pressure differential $\Delta P_{sys}$ rises over the check preload. The check valve may simply stays open if it has not closed yet in step 63 when the cycling-off period is substantially short. Thus, during continuous compressor cycling in steps 63 and 64, the repetitive hiss noise spikes are significantly reduced.

After shut down of the air conditioning system, both the valve element and the check valve close in step 65. Again, there is significant refrigerant bleeding before the closure of the check valve, which help prime the evaporator for the next AC system start-up with a low hiss noise spike if its charge status or distribution is not substantially altered during the long period of the AC system down time.

In step 66, if the underhood is cooler than the interior or HVAC, then the check valve stays closed and charge migration is prevented. On the other hand, if the underhood is hotter than the interior in step 67, there is no charge migration unless or until the temperature differential is high enough for the corresponding saturation pressure differential to overcome the bias of the check preload. Therefore, in most instances, there is no charge migration around Ports A and B.

The present invention is particularly effective in reducing hiss noise during compressor cycling. Thus, the bleed path of the present invention can be used in combination with other hiss reduction methods described above which may be even more effective at system start-up. The present invention is very advantageous in that it provides a compact and easily manufactured mechanism for addressing hiss noise. A checked bleed valve can be easily manufactured by drilling a two-step hole in the valve body and then inserting a spring and ball together with a valve seat in the larger end of the hole. The whole structure can be contained within a typical expansion valve package with no major tooling change and no resulting vehicle assembly or packaging issues.

What is claimed is:

1. An expansion valve for an air conditioning system circulating refrigerant through a compressor, a condenser, and an evaporator, comprising:

an inlet for receiving refrigerant liquefied in the condenser;

an outlet for supplying refrigerant to the evaporator;

a valve element for controlling flow of refrigerant between the inlet and the outlet, wherein the valve element is normally closed;

a control assembly coupled to the valve element and responsive to at least one temperature or pressure in the air conditioning system to open the valve element to variably meter the refrigerant to the evaporator; and a bleed passage between the inlet and the outlet, bypassing the valve element; and a check valve in series with the bleed passage for substantially blocking refrigerant flow in the direction from the outlet to the inlet, wherein the check valve is biased for blocking refrigerant flow in the direction from the inlet to the outlet unless the pressure of refrigerant in the inlet is greater than the pressure of refrigerant in the outlet by a predetermined threshold.

2. The expansion valve of claim 1 wherein the bleed path has an effective flow area between about 0.2 $mm^2$ and about 1.77 $mm^2$.

3. The expansion valve of claim 1 wherein the bleed path has an effective flow area between about 0.5 $mm^2$ and about 0.79 $mm^2$.

4. The expansion valve of claim 1 wherein the predetermined threshold is comprised of a pressure selected from the range between about 1 bar and about 7 bar.

5. The expansion valve of claim 1 wherein the predetermined threshold is between about 3 bar and about 5 bar.

6. The expansion valve of claim 1 wherein the check valve is comprised of a spring-loaded ball valve.

7. The expansion valve of claim 1 wherein the control assembly comprises:

a sensing chamber having a second inlet coupled to an outlet of the evaporator and a second outlet coupled to a suction line of the compressor; and a charge assembly comprising a diaphragm, a charge chamber contacting one side of the diaphragm, a pressure chamber contacting the other side of the diaphragm and in fluid communication with the sensing chamber, and a linkage coupling the diaphragm to the valve element.

8. A method of circulating refrigerant in an air conditioning system, comprising the steps of:

providing a source of refrigerant;

metering the refrigerant through an expansion valve to an evaporator, wherein the expansion valve includes an inlet and an outlet coupled through a valve element, and wherein the amount of refrigerant being metered to the evaporator is determined by moving the valve element in response to at least one temperature or pressure in the air conditioning system; and if the air conditioning system pressure differential is being or is already built up and the valve element is closed, then allowing refrigerant to flow through a bleed passage from the inlet to the outlet bypassing the valve element only if the pressure of refrigerant in the inlet is greater than the pressure of refrigerant in the outlet by a predetermined threshold, and at all times blocking refrigerant flow through the bleed passage from the outlet to the inlet.

9. The method of claim 8 wherein the predetermined threshold is comprised of a pressure selected from the range between about 1 bar and about 7 bar.

10. The method of claim 8 wherein the predetermined threshold is between about 3 bar and about 5 bar.

11. A method of circulating refrigerant in an air conditioning system, comprising:

providing a compressor, a condenser, a receiver, evaporator, and an expansion valve, wherein the expansion valve includes a port A and a port B coupled through a valve element and a bleed passage in parallel with the valve element;

metering at least part of a refrigerant flow to the evaporator by moving the valve element in response to at least one temperature or pressure at the outlet of the evaporator;

bleeding refrigerant through the bleed passage to the evaporator for a period of time after the compressor is off, thereby priming the system and resulting in lower noise at the next compressor on; and providing a check valve in series with the bleed passage for substantially blocking refrigerant flow in the direction from the port B to the port A, wherein the check valve is biased for blocking refrigerant flow in the direction from the port A to the port B unless the pressure of refrigerant in the port A is greater than the pressure of refrigerant in the port B by a predetermined threshold.

* * * * *